US011205334B1

(12) United States Patent
Delfin

(10) Patent No.: US 11,205,334 B1
(45) Date of Patent: Dec. 21, 2021

(54) PORTABLE CHILD MONITORING SYSTEM

(71) Applicant: Ramon Rodriguez Delfin, Hialeah, FL (US)

(72) Inventor: Ramon Rodriguez Delfin, Hialeah, FL (US)

( * ) Notice: Subject to any disclaimer, the term of this patent is extended or adjusted under 35 U.S.C. 154(b) by 0 days.

(21) Appl. No.: 17/378,724

(22) Filed: Jul. 18, 2021

(51) Int. Cl.

| | |
|---|---|
| ***G08B 21/04*** | (2006.01) |
| ***G08B 25/10*** | (2006.01) |
| ***G08B 5/36*** | (2006.01) |
| ***G08B 21/22*** | (2006.01) |

(52) U.S. Cl.
CPC ..... *G08B 21/0423* (2013.01); *G08B 5/36* (2013.01); *G08B 21/0469* (2013.01); *G08B 21/22* (2013.01); *G08B 25/10* (2013.01)

(58) Field of Classification Search
CPC ..... G08B 21/43
See application file for complete search history.

(56) References Cited

U.S. PATENT DOCUMENTS

2007/0200716 A1* 8/2007 Haase ..... G08B 21/0202 340/574
2008/0186165 A1* 8/2008 Bertagna ..... G08B 21/0261 340/539.13
2015/0019982 A1* 1/2015 Petitt, Jr ..... G08B 5/36 715/738

* cited by examiner

*Primary Examiner* — Travis R Hunnings
(74) *Attorney, Agent, or Firm* — Ruben Alcoba, Esq.

(57) ABSTRACT

The child monitoring system that is composed of a portable detector that detects the passage of a child or an adult through a linear perimeter and a receiver that receives an alarm from the portable detector. The detector is programmed to transmit an alarm when the detector detects a child has passed through the linear perimeter and the detector does not detect an adult passing through the linear perimeter within a period. If the system detects that a child has passed through the linear perimeter, then the system is programmed to determine if an adult has also passed thought the linear perimeter, if no adult passes through the linear perimeter within a period, then the detector will transmit a transmission to a wireless receiver that will alarm a caregiver of the child that the child has left the secured area.

1 Claim, 10 Drawing Sheets

PORTABLE CHILD MONITORING SYSTEM

BACKGROUND

The present invention pertains to a portable child monitoring system that will set off an alarm when an adult is not in the immediate vicinity of a child when a child passes a linear perimeter.

The invention is a system that is made to capture the passage of a child through a linear perimeter when a child leaves a secured area and then the system analyzes whether to transmit an alarm to a receiver. The alarm will inform the caretaker of the child holding the receiver that the child has passed through the linear perimeter.

The system is programmed not to transmit the alarm if an adult is in the vicinity of the child within a set period from the child passing through the linear perimeter.

The system is programmed to detect the passage of a child through a linear perimeter and then to immediately thereafter commence a timer in which an adult must pass through the linear perimeter to prevent the alarm from being transmitted.

The system is programmed to shoot a first packet of pulses at a first set height and a predetermined distance of a linear perimeter and to determine if any object has interfered with the first packet of pulses reaching the predetermined distance of the linear perimeter. If an object has interfered with the first packet of pulses and prevents the first packet of pulses from reaching the predetermined distance of the linear perimeter, then the system will recognize that a child has passed through the linear perimeter and that the child has left a secured area. The system then will shoot a repeated second packet of pulses for a set period at a second height and predetermined distance of the linear perimeter to determine if an adult is with the child. If the detector detects an adult within the period, then the detector will not transmit an alarm to a caregiver of the child and the system will continue sending alternating first and second packets of pulses to the linear perimeter. If the detector does not detect an adult, then the detector will transmit a transmission to a receiver that will alarm the caretaker of the child that the child has passed through the linear perimeter.

The system uses a detector that is programmed to shoot alternative first and a second packets of pulses through a linear perimeter. The detector is a portable device that is battery powered that has at least one distance sensor that directs a first and a second packet of pulses through the linear perimeter. The at least one distance sensor is controlled by a processor that is programmed to determine the predetermined distance in which each pulse is to reach. The program determines if an object has interfered with the predetermined distance in which each pulses was to reach, if an object interferes with the predetermined distance, then the program will have rules whether to send an alarm transmission to a caregiver. If the alarm transmission is sent to the caregiver, the alarm transmission will be received on a wireless receiver that has at least one alarm. The alarm can, be either an audio alarm, a visual alarm, or both.

The present invention provides a system that detects a child passing a linear perimeter and that only transmits an alarm if the child has passed the linear perimeter and an adult is not detected passing the linear perimeter within a set period.

SUMMARY

The present invention is directed to a portable child monitoring system that only sounds an alarm when an adult is not present when a child passes through a linear perimeter.

A child monitoring system that is composed of a portable detector that shoots a sequential series of alternating packet of pulses to a linear perimeter. The detector is programmed to transmit an alarm when a pulse, from the first packet of pulses detects that a child has passed through the linear perimeter and a pulse from a second packet of pulses does not detect an adult in the linear perimeter within a period. If a pulse from the first packet of pulses detects a child in the linear perimeter, then the system is programmed to determine if an adult crosses the linear perimeter within the set period. If no adult crosses the perimeter, then the detector Till transmit a transmission to a wireless receiver that will alarm a caregiver of the child that the child passed through the linear perimeter and has left a secured area and that the child is not in the company of an adult.

The detector is comprised of a housing that houses a processor, a battery, an RGB LED light, and a radio frequency transceiver. A telescoping tube that defines a first through hole and an open top that is attached to the housing. A first distance sensor is attached to the telescoping tube at a position that is within the telescoping tube and that directs a first packet of pulses outward from the first through hole. An articulating extension that defines a second through hole, the articulating arm attaches to the open top of the telescoping tube. A second distance sensor is attached to the articulating arm extension at a position that is within the articulating arm and that directs a second packet of pulses outward from the second through hole. The first distance sensor and the second distance sensor are operatively connected to the processor. An antenna that is connected to the transceiver. The first through hole is positioned on the telescoping arm at a position that will allow the first distance sensor to detect any variations in distances measured. The second through hole is positioned on the articulating arm extension at a position that will allow the second distance sensor to detect any variations in distance measured. The first distance sensor and second distance sensors emit linear pulses. The radio transmitter emits short-wavelength ultrahigh frequency radio waves.

The wireless receiver comprises of housing that houses a processor, a radio frequency transceiver, an RGB LED light, an audio alarm, a battery, a stop button that cancels an alarm, and an antenna. The wireless receiver is programmed to sound an alarm when it receives a transmission from the detector that a child has passed through a linear perimeter and an adult was not detected within the linear perimeter within a set period.

RGB LED light is defined to mean a red, green, and blue light emitting diode light.

In an alternative embodiment of the present invention, the articulating arm and the second distance sensor are not included in the system and the first distance sensor is programmed to detect two linear distance measurements from the first distance sensor and when an adult is not detected in the two linear measurements within a set period, a transmission will be sent from the transmitter of the detector to the receiver that will activate the alarms of the receiver. This alternative embodiment is placed on a ceiling.

An object of the present invention is to provide a child monitoring system that will notify an adult that a child has passed through a linear perimeter and that the child is not in the company of an adult.

Another object of the present invention is to provide a child monitoring system that gives an adult the comfort of knowing when a child has left a secured area.

Yet another object of the present invention is to provide a child monitoring system that will minimize the chances of a child being injured when the child leaves a secured area.

DRAWINGS

These and other features, aspects, and advantages of the present invention will become better understood with regards to the following description, appended claims, and drawings where:

FIG. 1*a* is a vertical perspective view of the present invention;

FIG. 1*b* is an embodiment of the present invention that is connected to the cloud;

FIG. 1*c* is a perspective embodiment of the present invention that connects all of the elements of the present invention to the cloud;

FIG. 2*a* is perspective view that shows the detector bar the present invention in a vertical position;

FIG. 2*b* is perspective view that shows the detector bar the present invention in a horizontal position;

FIG. 3 is a perspective that shows all of the elements of the detector bar;

FIG. 4*a* is a perspective view of the portable base;

FIG. 4*b* is block diagram of the portable base;

FIG. 5*a* is an example that shows a child passing through the detector bar when it is in the vertical position;

FIG. 5*b* is an example that shows a child and an adult passing through the detector bar when it is in the vertical position;

FIG. 5*c* is an example that shows an adult passing the detector bar when it is in the vertical position;

FIG. 6*a* is an example that shows a child passing through the detector bar when it is in the horizontal position;

FIG. 6*b* is an example that shows a child and an adult passing through the detector bar when it is in the horizontal position;

FIG. 6*e* is an example that shows an adult passing the detector bar when it is in the horizontal position;

FIG. 7*a* a shows the S1 and the S2 signals sent by the present invention;

FIG. 7*b* shows the Vertical Bar Calibration Mode;

FIG. 7*c* shows the Horizontal Bar Calibration Mode;

FIG. 7*d* shows the Ready mode of either the Vertical bar or the Horizontal Bar;

FIG. 8*a* shows how the system calculates a child passing through the detector bar;

FIG. 8*b* shows how the system calculates a distance when there is no barrier in front of the vertical bar;

Figure 12A:
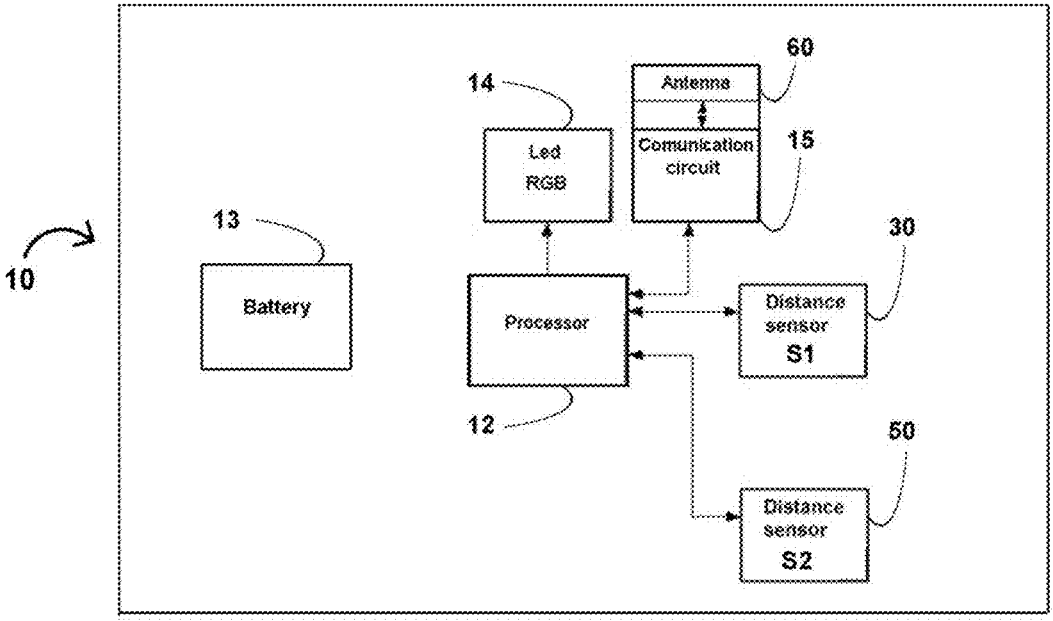

FIG. 12*a* is a block diagram of the detector bar; and

Figure 12B:
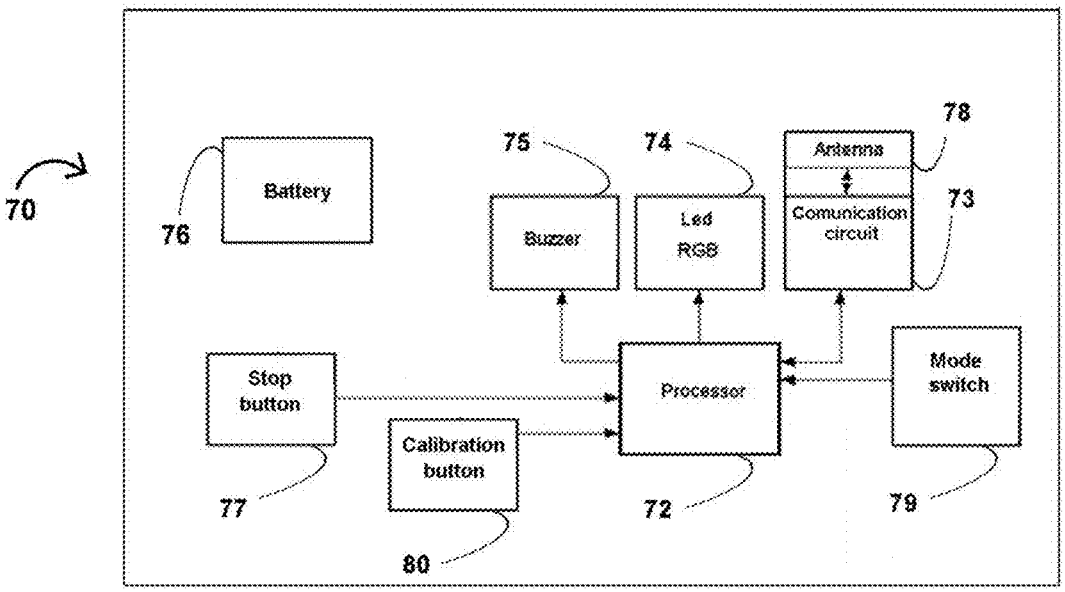

FIG. 12*b* is a block diagram of the portable base.

DESCRIPTION

Figure 1A:
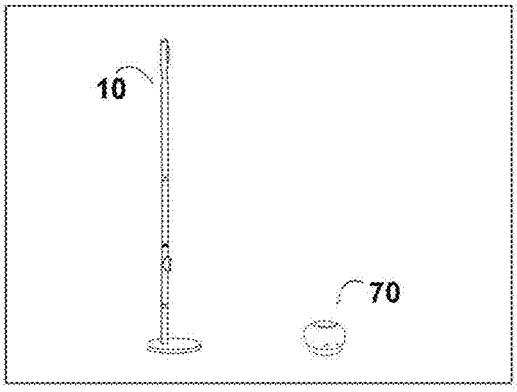
Figure 1B:
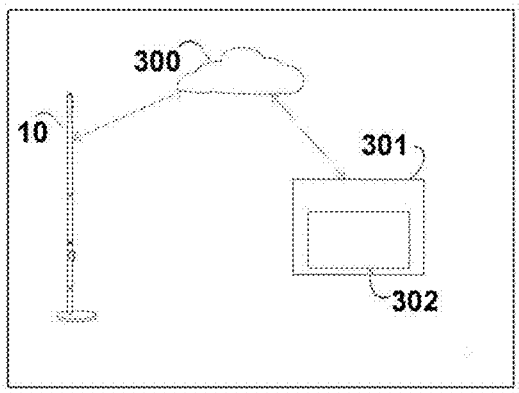
Figure 1C:
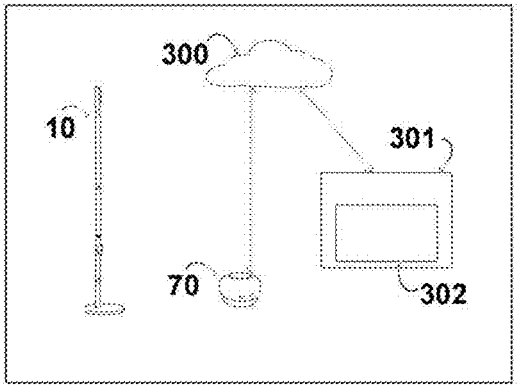

The present invention is directed to portable system that is used to monitor infants. The system comprises of a detector bar 10 and a portable base 70 (as shown in FIG. 1*a*). In an embodiment of the present invention, the portable base can be substituted using a paired device 301 and a network 300, the paired device 301 and the network 301 will use an application that is configured to communicate with the detector bar 10 (as shown in FIG. 1*b*) or the paired device 301 and the network can also connect to the portable base 70 (as shown in FIG. 1*c*).

Figures 2A, 2B:
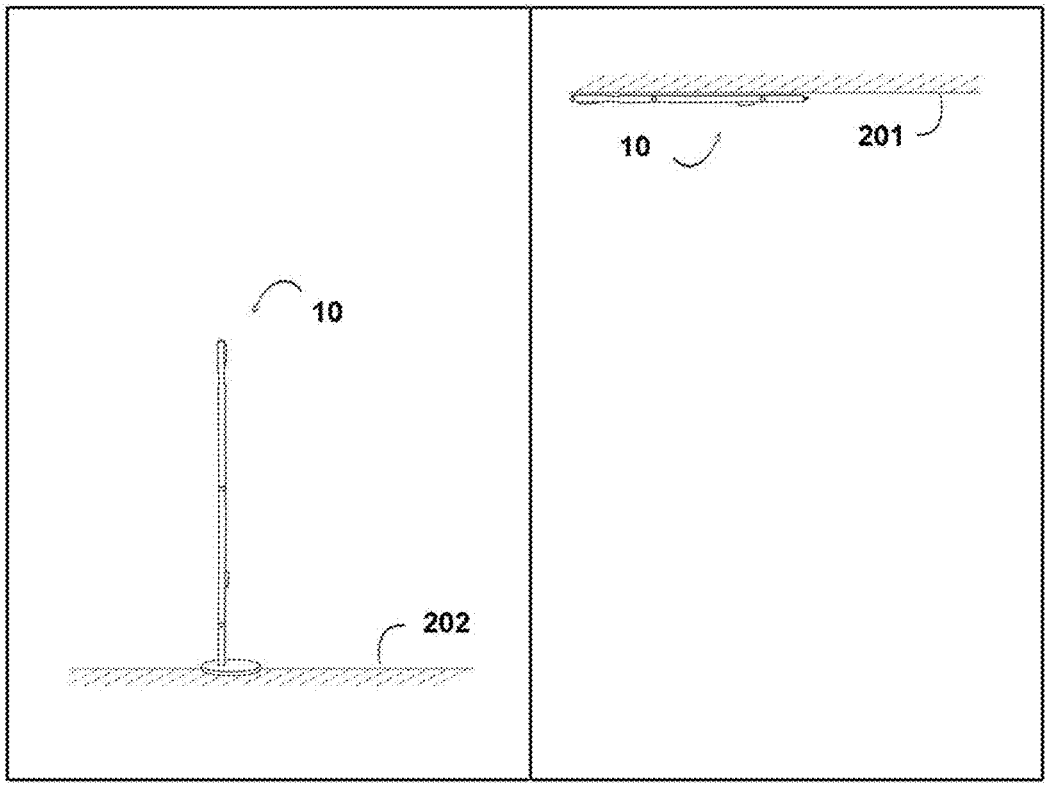

The system shown in FIG. 1*a* is configured to detect when a child passes through a linear perimeter that is monitored by the detector bar 10 and is only configured to activate an alarm on the portable base 70 when adult does not pass through the linear perimeter in which the child passed within a set specific period. FIGS. 2*a* and 2*b* show two different positions in which the detector bar 10 can be used. FIG. 2*a* shows a configuration wherein the detector bar 10 is placed vertically on a floor 202, this configuration shall be referred as the Vertical Bar configuration hereinafter. FIG. 2*b* shows a configuration wherein the detector bar 10 is placed horizontally on a roof 201, this configuration shall be referred as the Horizontal Bar. The two configurations shall be described further below.

Figure 3:
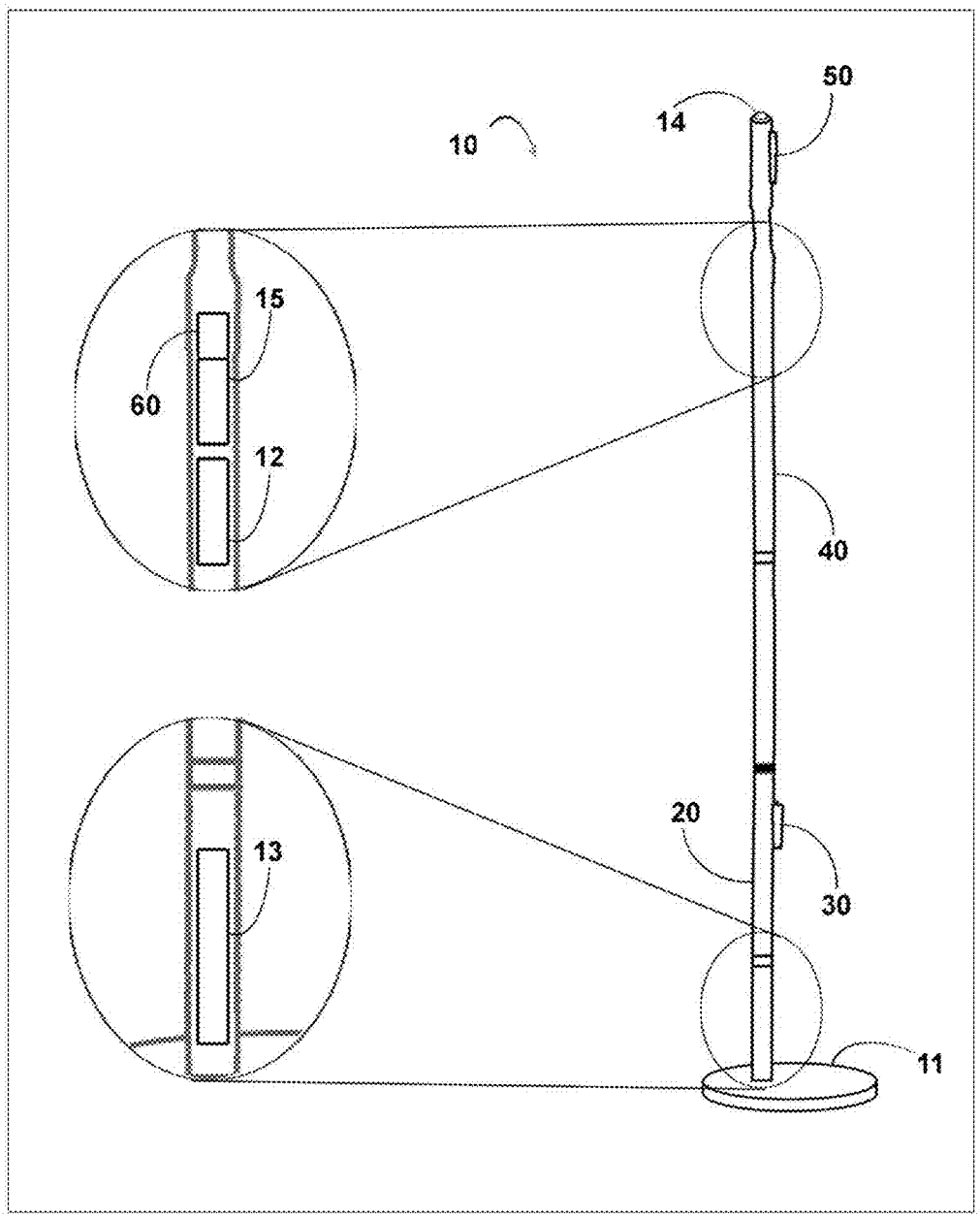

FIG. 3 shows the detector bar 10. The detector bar 10 comprises of a removable base 11. A telescopic tube 20 that houses a battery 13 and a first distance sensor 30 that is attached to the removable base. An extension bar 40 that houses a processor 12, a transceiver 15 (a communication circuit) that has an integrated antenna 60, a RGB LED, and a second distance sensor 50. The extension bar 40 attaches to the telescopic tube 20. The battery 13, the first distance sensor 30, the processor 12, the transceiver 15 that has the integrated antenna 60, the RGB LED 14, and the second distance sensor 50 are all operatively connected.

Figure 4A:
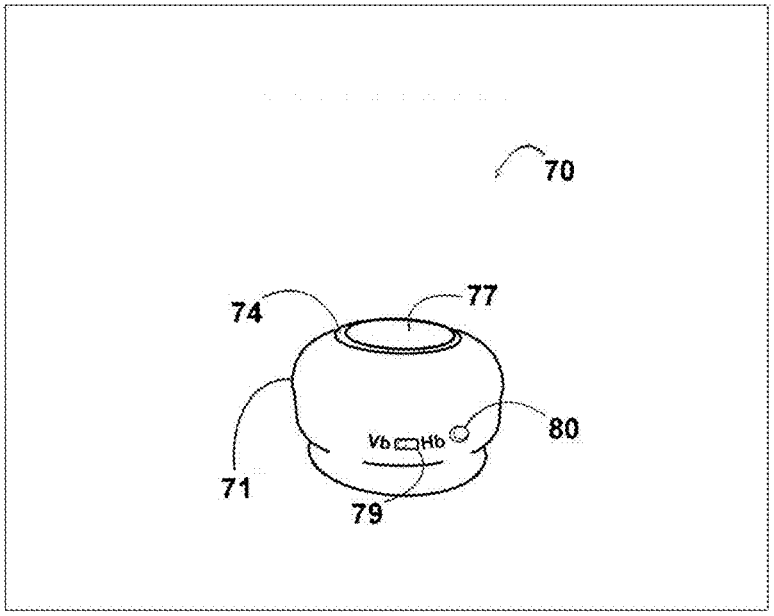
Figure 4B:
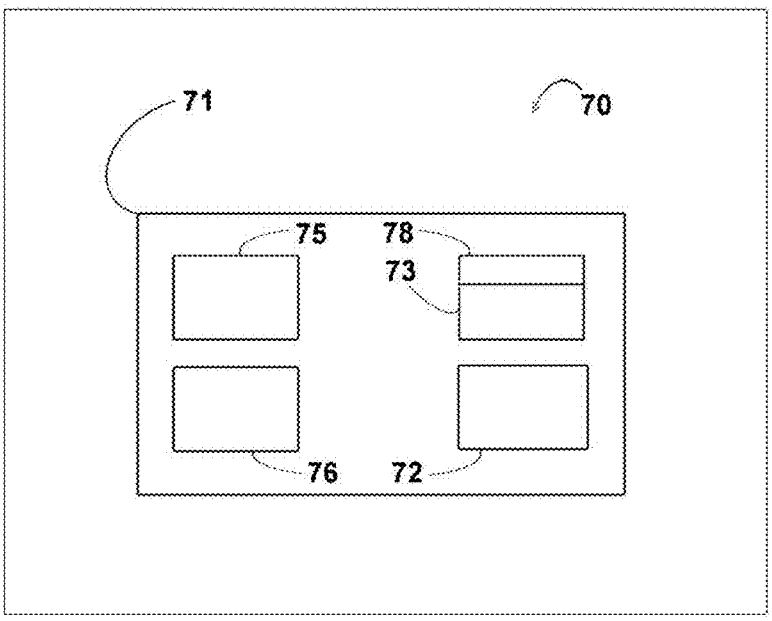

FIG. 4 shows the portable base 70. The portable base 70 comprises of a housing 71 that defines a stop button 77, a mode switch 79, a calibration button 80, and a RGB LED 74 on an exterior of the portable base. The housing 71 (as shown in FIG. 4*b*) houses a battery 76, a processor 72, a transceiver 73 (a communication circuit) that has an integrated antenna 78, and an audio alarm 75 (also referred as the buzzer). The stop button 77 the mode switch 79, the calibration button 80, the RGB LED 74, the battery 76, the processor 72, the transceiver 73 that has the integrated antenna 78, the audio alarm 75 are all operatively connected. The portable base 70 and the detector bar 10 are configured to wirelessly to communicate with each other and to transmit an alarm when an adult is not present in the vicinity of a child in the linear perimeter being monitored.

The Vertical Bar configuration is shown in FIG. 2*a*: the Portable base 70 (FIG. 4*a*), place mode switch 79 in position (Vb), when activating the calibration button 80, we send an RF signal through the communication circuit 73 of the portable base 70 (FIG. 4*b*) to the transceiver 15 of the detector bar 10 (FIG. 3), dropping the system into calibration mode. The user of the present invention must make sure that during the calibration time that there is no presence of a child or an adult within the monitored linear perimeter. Each sensor will perform a package of 6 distance measurements (FIG. 7*a*) sequentially, from which we select the minimum measurement of each of the sensors (S1, S2) setting this value to the variable Da (FIG. 7*b*), if the sensors do not detect an object before 250 cm (this value may vary depending on the distance sensors used), it will assume this value as (Da) FIG. 8*b*, that is, (Da) would be equal to 250 cm. The calibration time is 5 seconds, after this time the equipment automatically enters Ready mode.

Figure 7A:
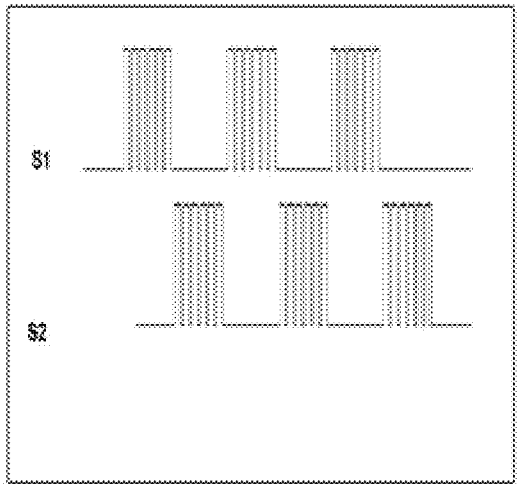
Figure 7B:
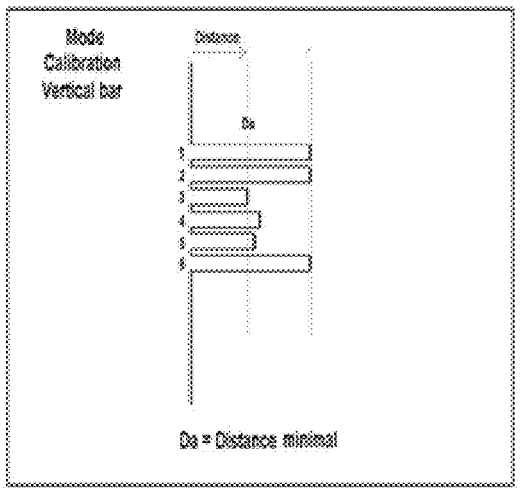
Figure 7C:
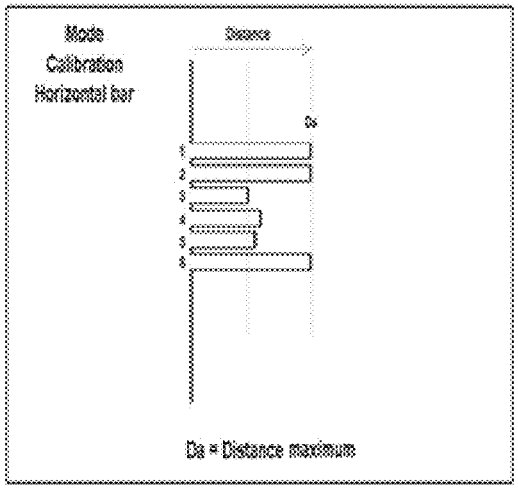

The Horizontal Bar configuration is shown in FIG. 2*b*: the portable base 70 (shown in FIG. 4*a*), place the mode switch 79 in position Hb, when activating the calibration button 80, we send an RF signal through the transceiver 73 of the portable base 70 (FIG. 4*b*) to the transceiver 15 of the detector bar 10 (as seen in FIG. 3), falling into a calibration mode. We must make sure that during the calibration time there is no presence of a child or an adult within the monitored linear perimeter. Each sensor will perform a package of 6 distance measurements (as seen in FIG. 7*a*) sequentially, from which we select the maximum measurement of each of the sensors (S1, S2) setting these values to the variable (Da) of each sensor (FIG. 7*c*), In this case (Da) being equal to the distance from the detector bar 10 to the floor 202. The calibration time takes 5 seconds, after this time the equipment automatically enters Ready mode.

Figure 7D:
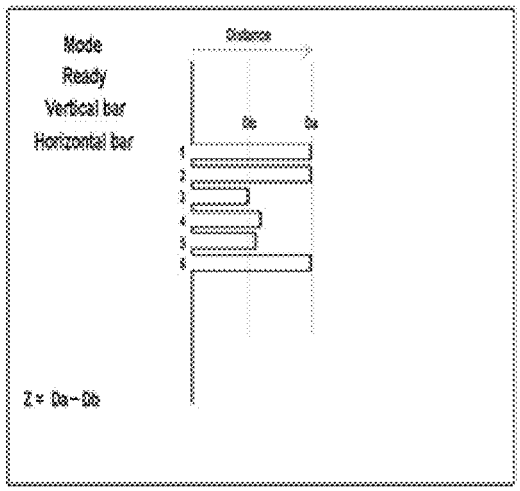
Figure 8A:
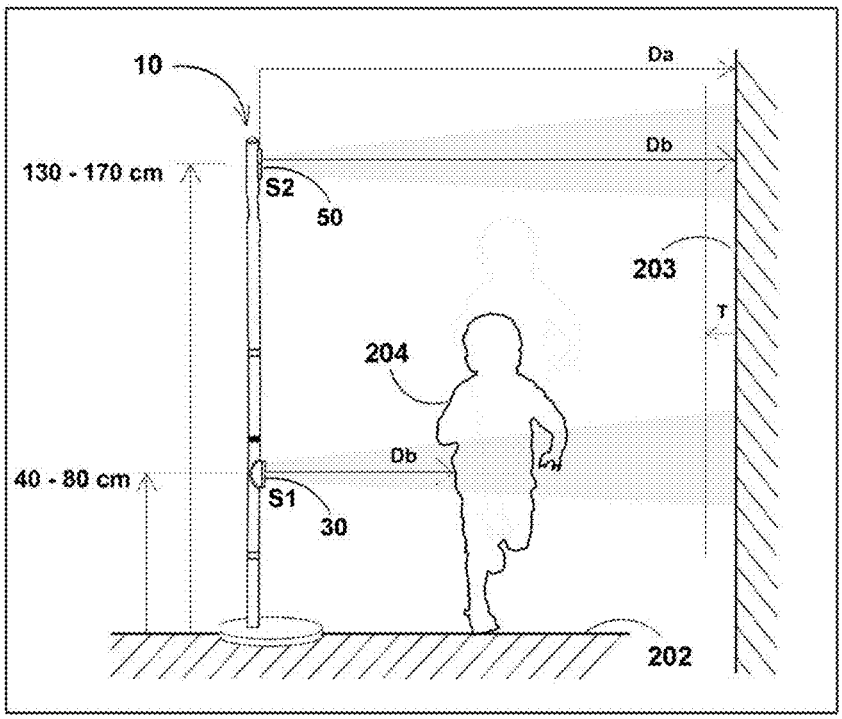

Ready mode Vertical Bar (as shown in FIG. 8*a*). The Detector bar 10 is placed on the floor 202, the telescopic tube 20 has a first distance sensor 30 (S1) that is placed at a distance from the floor 202 of 40 to 80 cm and the extension tube 40 has a second distance sensor 50 (S2) that is placed at a distance from the 202 floor of 130 to 170 cm. Each sensor performs a package of 6 distance measurements (FIG. 7*a*) sequentially, from which the system records the lowest distance measurement (Db) from each sensor (S1 and S2) (shown in FIG. 7*d*), given by a possible presence of an adult or child, the difference (Z) is calculated for each sensor (S1 and S2), where (Da) is the distance given by the calibration (Vertical Bar) of each sensor (S1, S2) (FIG. 7*b*), and Db the minimum distance of each sensor (S1, S2) in Ready mode (FIG. 7*d*).

$$Z=Da-Db$$

Figure 8B:
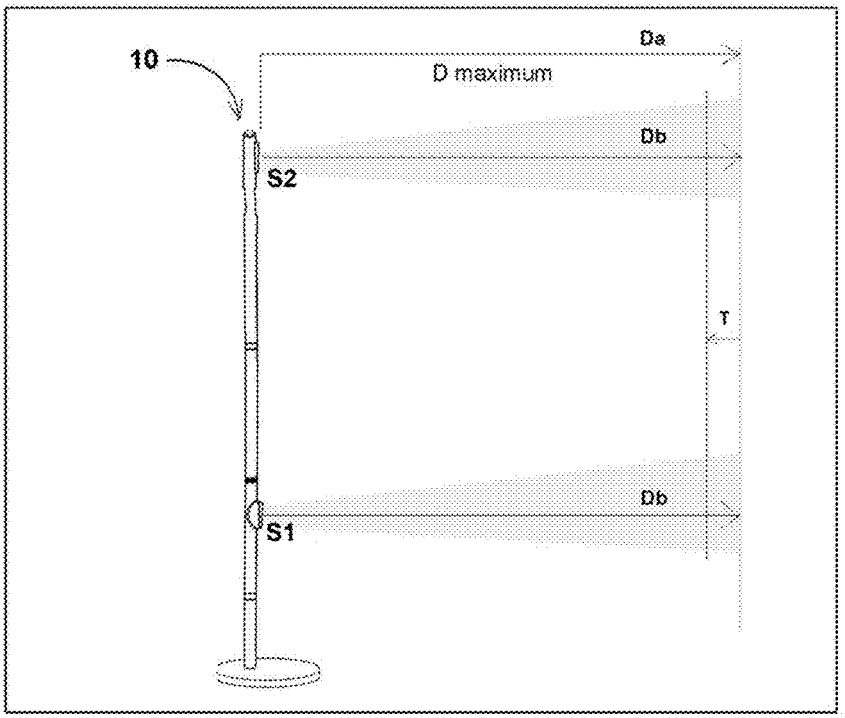

We create the constant (tolerance) of 40 cm (FIG. 8*a*) that guarantees no false alarms are activated due to slight movements such as curtains, etc.). In the case that there is no barrier such as a wall etc. FIG. 8*b*.

When in S1, S2 the difference is Z<T The object is ignored.

When in S1 the difference is Z>T (child presence zone), a count is started before activating the alarm, verifying the presence of an adult.

When in S2 the difference is Z>T (adult presence zone): a—The object is ignored. b—The presence of the child is ignored, having started the count (period). c—If the alarm is activated in the portable base 70, the alarm is interrupted (stop).

Figures 5A, 5B, 5C:
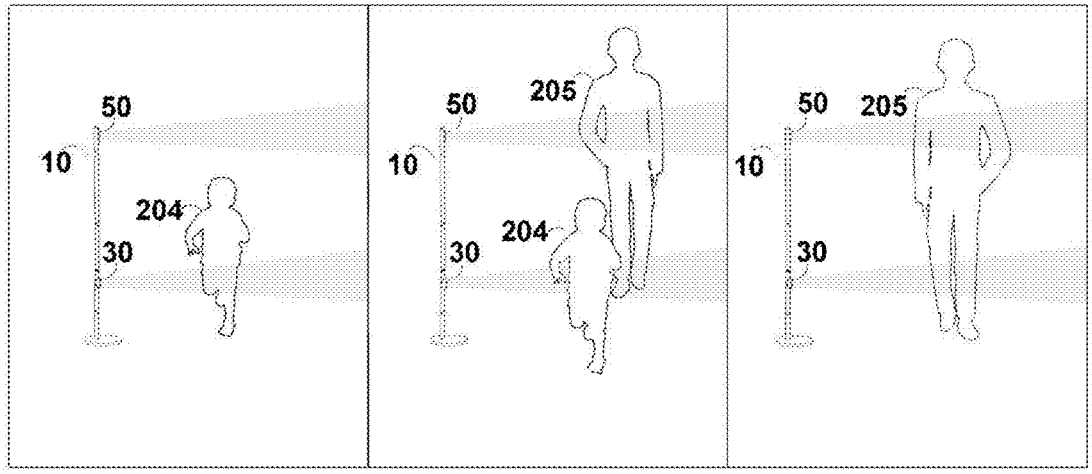

As soon as S1 detects the presence of a child 204 (as seen in FIG. 5*a*) the system begins a 3-second count, if (S2) detects the presence of an adult 205 during this time (as seen in FIG. 5*b*), the alarm is not activated, if (S2) does not detect the presence of an adult 205 during this time, the presence of an unsupervised child is confirmed (FIG. 5*a*), activating the sound and light alarm on the Portable base 70. If the system detects the presence of an adult 205 (as seen in FIG. 5*c*), the system is disabled for 6 seconds, after this time the surveillance is restored again.

Figure 9:
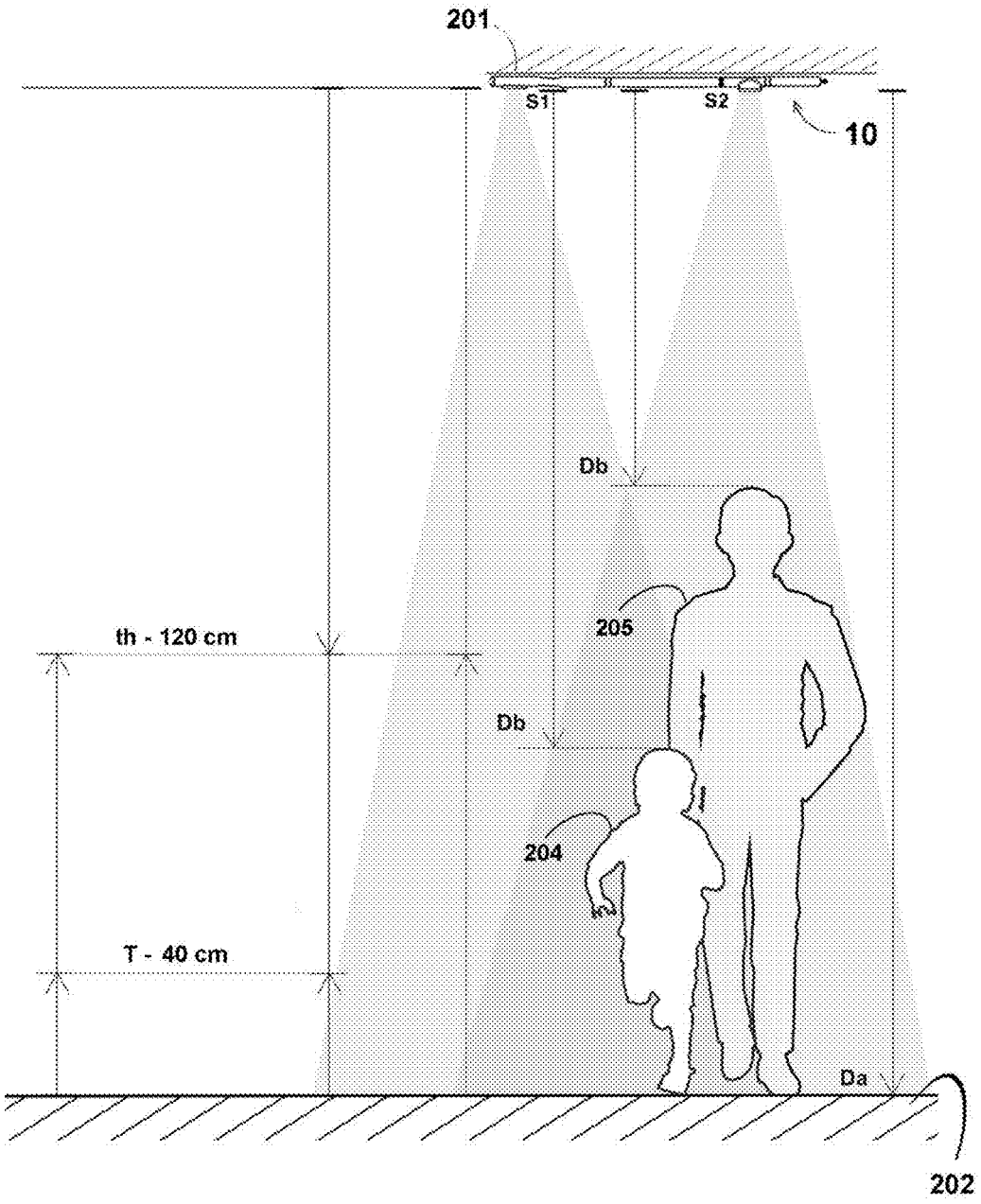
FIG. 9 Shows how the system, when in the Horizontal Bar position calculates the presence or non-presence of an object, child, or an adult.

Ready mode Horizontal (as shown in FIG. 9). The Detector bar 10, is placed on the ceiling 201, the telescopic tube 20 allows us to vary its length depending on the perimeter that we want to monitor. It has a first distance sensor 30 (S1) and the extension bar 40 a second distance sensor 50 (S2) Each sensor performs a package of 6 distance measurements (as seen FIG. 7*a*) sequentially, from which the system records the closest distance measurements (Db) from the sensor S1 and S2 (FIG. 7*d*), the closest distance measurement (Db) given by a possible presence of an adult or child, the difference (Z) is calculated, from the sensors (S1 and S2), where (Da) is the distance given by the calibration (horizontal bar) of each sensor (S1, S2) (FIG. 7C) and Db the minimum distance of the sensor (S1, S2) in Ready mode (FIG. 7*d*).

$$Z=Da-Db$$

As shown in FIG. 9, the system determines the constant T (tolerance) of 40 cm. This guarantees that false alarms do not occur due to small objects that are on the ground or due to the presence of pets. We system creates the constant th (threshold) of 120 cm that establishes that below this distance value a child is identified and above this distance value an adult is identified.

When in S1 the difference is S2 Z<T. The object is ignored.

When in S1, S2 the difference is Z>T<th (child presence zone). A count is started before activating the alarm verifying the presence of an adult.

When in S1, S2 the difference is Z>th (adult presence zone). a—The object is ignored. b—The presence of the child is ignored after having started the count. c—If the alarm is activated in the portable base, the alarm is interrupted (stop).

Figures 6A, 6B, 6C:
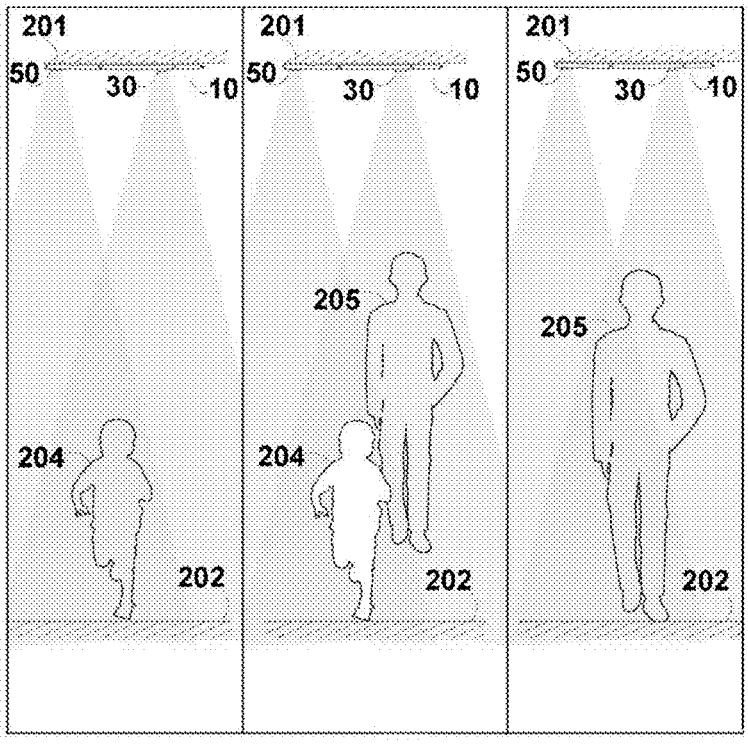

As soon as the system detects the presence of a child 204 (as seen in FIG. 6*a*), a 3 second count begins to see if an adult 205 is also in the presence of the child (FIG. 6*b*), if the presence of an adult 205 is detected, then the alarm is not activated. If the presence of an adult 205 is not detected, then the presence of a child 204 is confirmed without supervision (FIG. 6*a*) and the audio and the visual alarms of the Portable base 70 are activated. If the system detects the presence of an adult 205 (as seen in FIG. 6*c*) the system is disabled for 6 seconds, after this time surveillance is restored again.

As seen in FIGS. 12*a* and 12*b* show the Block diagrams of the Detector bar 10 and the Portable base 70. These will be described for a better understanding.

Block diagram Detector bar (10) (FIG. 12*a*) is provided by: Processor (12), Distance sensor S1 (30), Distance sensor S2 (50), Communication circuit (15), Antenna (60), RGB LED (14), Battery (13).

Figure 10:
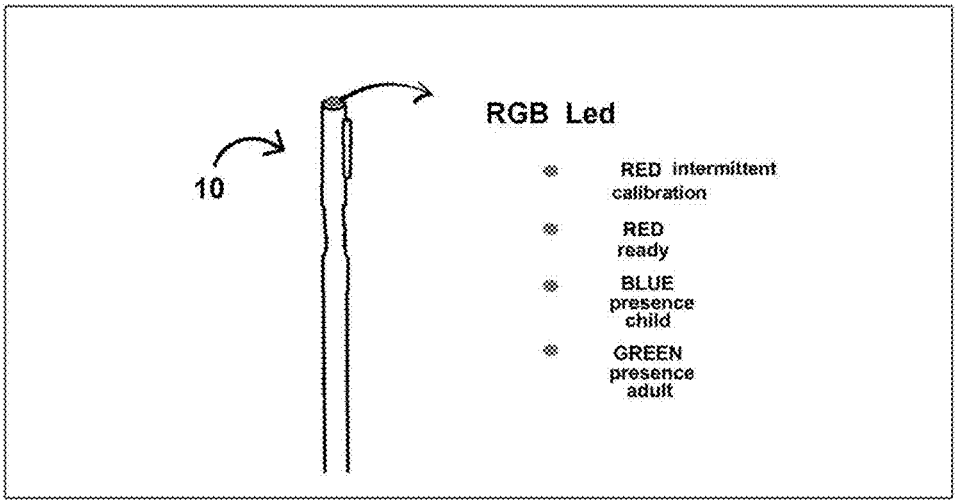
FIG. 10 shows a depiction and a key of the RGB LED signals of the detector bar.

The Distance sensor 30 S1 block provides the Processor 12 with the data on the distance of the child's presence and the distance sensor 50 S2 block with the data on the distance of the adult presence, which through its algorithm will be processed and sent to the transceiver/Communication circuit 15 and Antenna 60 to be transmitted by radio frequency in the 2.4 GHz band to the Portable base 70. The transceiver/Communication circuit 15 and Antenna 60 block also receives from the Portable base 70 the signal for the corresponding calibration of the Detector bar 10. The Processor block 12 also supplies the data to the RGB LED 14 block, which provides us with the light signaling as shown in FIG. 10:

a) RED flashing—Calibration Mode
b) RED—Ready Mode
c) BLUE—Child is present.
d) GREEN—Adult is present.

The Battery block 13 provides the necessary energy to the Detector bar 10.

Portable base block diagram 70 (as seen in FIG. 12*b*) is comprised of: a processor 72, a transceiver/Communication circuit 73, an antenna 78, a mode switch 79, a calibration button 80, a stop button 77, an audio alarm/Buzzer 75, a RGB LED 74, and a battery 76.

The Processor block 72 receives the data through the blocks:

1—the communication circuit 73, the antenna 78—presence of child and presence of adult of the Detector bar 10 by Radio Frequency of 2.4 GHz.

2—Mode switch 79—If working in Vertical bar mode (as seen in FIG. 2*a*) or Horizontal bar mode (as seen in FIG. 2*b*).

3—Stop button 77—If the sound and light alarm are activated, then through this button they are deactivated, entering Ready mode again.

4—Calibration button 80—by pressing this button on the portable base 70, the portable base 70 enters into an automatic calibration mode. In this mode the portable base 70 transmits a signal to the detector bar 10 to force it to fall into automatic calibration mode. This process takes 5 seconds after this time the system enters Ready Mode again.

Figure 11:
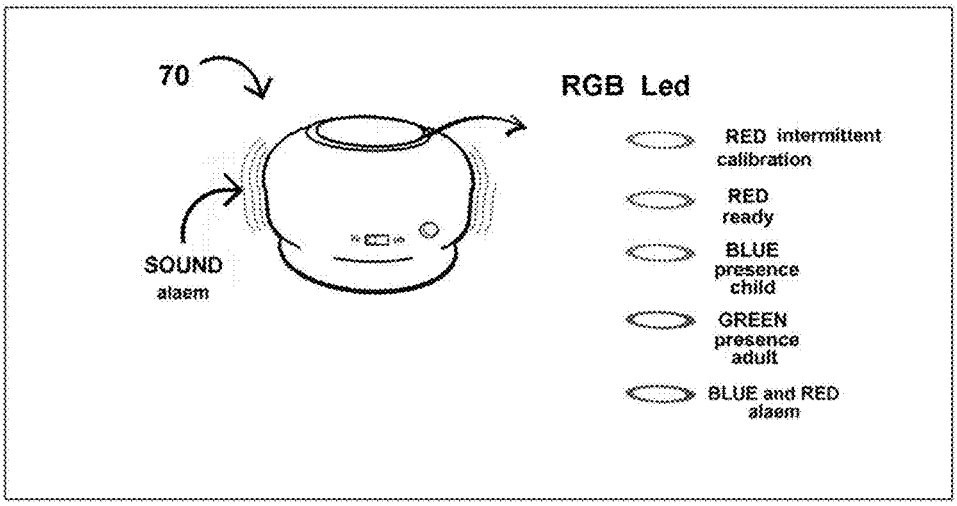
FIG. 11 shows a depiction and a key of the RGB LED signals of the portable base and a depiction of the audio alarm of the present invention.

The Processor block 72 through its algorithm processes the data and they are sent to the blocks:

1—RGB Led 74—Responsible for supplying the light signaling as shown in FIG. 11: a) RED Flashing—Calibration Mode b) Red—Ready Mode c) BLUE—a child is present in the monitored area, a 3-second count begins verifying the absence of an adult.

d) GREEN—an Adult is present in the monitored area.

e) RED and BLUE—An adult is not present and a child was detected in the monitored area.

2—Buzzer 75—In charge of supplying the sound signaling (Alarm).

The Battery block 76 provides the necessary energy to the Portable base 70.

An advantage of the present invention is that it provides a child monitoring system that notifies an adult that a child has left an area being monitored.

Another advantage of the present invention is that it provides a child monitoring system that gives an adult the comfort of knowing when a child has left a predetermined area.

Yet another advantage of the present invention is that it provides a child monitoring system that minimizes the chances of a child being injured when the child leaves a safe monitored area.

The embodiments of the portable child monitoring system described herein are exemplary and numerous modifications, combinations, variations, and rearrangements can be readily envisioned to achieve an equivalent result, all of which are intended to be embraced within the scope of the appended claims. Further, nothing in the above-provided discussions of the portable child monitoring system should be construed as limiting the invention to an embo upper casediment or a combination of embodiments. The scope of the invention is defined by the description, drawings, and appended claims.

What is claimed is:

1. A portable child monitoring system that detects when a child passes through a linear perimeter and that only transmits an alarm to a caregiver when an adult is not detected passing through the linear perimeter within a specific set period, the portable child monitoring system comprises:

a detector bar that comprises of:

a removable base;

a telescopic tube that houses a battery and a first distance sensor that is attached to the removable base; and an extension bar that houses a processor, a transceiver that has an integrated antenna, a RGB LED, and a second distance sensor, the extension bar attaches to the telescopic tube, the battery, the first distance sensor, the processor, the transceiver that has the integrated antenna, the RGB LED, and the second distance sensor are all operatively connected; and a portable base that comprises:

a housing that defines a stop button, a mode switch, a calibration button, and a RGB LED on an exterior of the housing, the housing houses a battery, a processor, a transceiver that has an integrated antenna, and an audio alarm, the stop button, the mode switch, the calibration button, the RGB LED, the battery, the processor, the transceiver that has the integrated antenna, the audio alarm are all operatively connected, the portable base and the detector bar are configured to wirelessly to communicate with each other and to transmit an alarm when an adult is not present in the vicinity of a child in the linear perimeter being monitored.

* * * * *